US006050879A

United States Patent [19]

Dubrovskiy et al.

[11] Patent Number: 6,050,879

[45] Date of Patent: Apr. 18, 2000

[54] PROCESS FOR LAPPING AIR BEARING SURFACES

[76] Inventors: Mikhail Yuriy Dubrovskiy, 555 Laurel St., #126, San Mateo, Calif. 94401; Yuri Igor Markevitch, 7250 Blue Hill Dr., San Jose, Calif. 95129; Siloe Flores Saldivar, 6056 Cotton Ct., San Jose, Calif. 95123; Cornelius Vladimir Sutu, 173 Clipper Dr., Pittsburg, Calif. 94565

[21] Appl. No.: 09/109,339

[22] Filed: Jun. 30, 1998

[51] Int. Cl.[7] ..... B24B 1/00

[52] U.S. Cl. ..... 451/36; 451/36; 451/63

[58] Field of Search ..... 451/36, 41, 63, 451/56; 438/692, 693; 216/88, 89

[56] References Cited

U.S. PATENT DOCUMENTS

| | | | |
|---|---|---|---|
| 4,448,634 | 5/1984 | Lampert | 156/636 |
| 4,685,440 | 8/1987 | Owens | 125/11 |
| 5,527,424 | 6/1996 | Mullins | 156/636.1 |
| 5,595,527 | 1/1997 | Appel | 451/28 |
| 5,632,667 | 5/1997 | Earl et al. | 451/41 |
| 5,655,951 | 8/1997 | Meikle et al. | 451/56 |
| 5,664,987 | 9/1997 | Rentein | 451/21 |
| 5,733,179 | 3/1998 | Bauer | 451/63 X |
| 5,755,613 | 5/1998 | Uchida et al. | 451/63 X |
| 5,902,172 | 5/1999 | Utashiro | 451/63 X |

FOREIGN PATENT DOCUMENTS

| | | |
|---|---|---|
| 3811 784 | 7/1989 | Germany . |
| 2 284 426 | 6/1995 | United Kingdom . |

*Primary Examiner*—Timothy V. Eley
*Attorney, Agent, or Firm*—Henry Croskell, Esq.

[57] ABSTRACT

The invention presents a method for conditioning and texturing of lapping plate surfaces used in high precision lapping, the conditioning and texturing is achieved without the use of free abrasive particles and slurries through use of a conditioning ring having a hard bound abrasive particle layer. The conditioning ring is contacted with the lapping plate surface, both rotating in the same direction but at different RPMs resulting in grooved microprofiles of the lapping plate surface. The invention provides a lapping process using the conditioned and textured lapping plate surface along with free abrasive particles carried in the grooves in combination with glycols and citrates for ABS generation.

5 Claims, 2 Drawing Sheets

PROCESS FOR LAPPING AIR BEARING SURFACES

BACKGROUND OF THE INVENTION

The present invention relates to a method for the manufacture of magnetic transducers and more particularly, to a lapping process for air bearing surfaces of the magnetic transducers. In another aspect, the invention relates to a method of conditioning and texturing of a lapping plate surface used in high precision lapping of magnetic transducing heads, air bearing surfaces.

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording disc are mounted on a spindle such that the disc can rotate to permit the magnetic head mounted on a movable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider". A slider generally serves to mechanically support the head and any electrical connections between the head and the rest of the disc drive system. The slider is aerodynamically shaped to glide over moving air and therefore to maintain a uniform distance from the surface of the rotating disc thereby preventing the head from undesirably contacting the disc.

Typically, a slider is formed with two parallel rails having a recessed area between the rails and with each rail having a ramp at one end. The surface of each rail that glides over the disc surface during operation is known as the air bearing surface.

Large number of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced ie., separated into individual sliders each slider having at least one magnetic head terminating at the slider air bearing surface.

The slider head is typically an inductive electromagnetic device including magnetic pole pieces which read the data from or write the data onto the recording media surface. In other applications the magnetic head may include a magnetoresistive read element for separately reading the recorded data with the inductive heads serving to only write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. During manufacturing, it is most critical to grind or lap these elements to very close tolerances of desired thickness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically transverse to or across the magnetic head elements exposed at the slider air bearing surface. In magnetic head applications the electrically active components exposed at the air bearing surface are made of relatively softer, ductal materials. These electrically active components during lapping can scratch and smear into other components causing electrical shorts and degraded head performance. The prior art lapping processes cause different materials exposed at the slider air bearing surface to lap to different depths resulting in recession of the critical head element relative to the air bearing surface. As a result, poor head performance because of increase space in between the critical elements and the recording disc can occur.

Rotating lapping plats having horizontal lapping surface in which abrasive particles such as diamond fragments are embedded have been used for lapping and polishing purposes in the high precision lapping of magnetic transducing heads. Generally in these lapping processes, an abrasive slurry utilizing a liquid carrier containing diamond fragments or other abrasive particles is applied to the lapping surface as the lapping plate is rotated relative to the slider or sliders maintained against the lapping surface. Common practice is to periodically refurbish the lapping plate with a lapping abrasion to produce a surface texture suitable for the embedding and retention of the appropriate size of diamond abrasive being used with the lapping process. One of several problems experienced is that the surface is susceptible to rapid change in smoothness as it is used to lap a workpiece principally due to fragments removed from the workpiece during lapping. A change in smoothness effects the hydrodynamic bearing film provided by the liquid component of the abrasive slurry creating a hydroplaning effect which raises the workpiece from the lapping surface to diminish the abrasion action of the particles and substantially increases abrasion time required.

The general idea of interrupting the lapping surface, for example, by forming grooves in the lapping plate is known in the art. Further, material as been used in the troughs so that unspent abrasive liquid is maintained adjacent the working surface of the lapping plate while spent abrasive fluid is centrifugally removed beyond the lap plate peripheral. In other applications, the grooves are formed between working surface area in which an abrasive such as diamond particles are embedded in a metallic coat.

Problems exist with grooved plates, for example, excessive width and/or depth of grooves to allow abrasive particles to loose their effectiveness due to lack of contact with a workpiece. Grooves that are too wide provide surface discontinuity too severe for small work pieces. Forming such grooves is costly and time consuming. Even if the grooves can be sized properly. Substantial segments of the lapping surface remain ungrooved, or alternatively a prohibitively large number of grooves are required. Surface uniformity on a micropore scale suitable for lapping smaller pieces has been achieved only with extreme care. Refurbishment of such sensitive grooving on a lapping surface requires renewal of the precision grooves can be time consuming and expensive. Therefore it can be seen that there is a need for precise conditioning and texturing of plate surfaces of lapping plates in order to maintain surface flatness, waviness, and microprofile of the grooves in the lapping (polishing) plate. It can also be seen that there is a need for on machine conditioning of lapping plates such conditioning and texturing extending lapping plate life as well as a need for better quality of the plate surface which results in better quality scratch free air bearing surfaces or other surfaces which require soft material lapping having a uniformly textured lapping surface amenable to repeat refurbishment.

Finally, it can also be seen that in wider fabrication methodology, a lapping and/or polishing surface must be provided which affords result in that the air bearing surface geometrics are produced with a high degree of certainty.

SUMMARY OF THE INVENTION

To overcome the limitations and the prior art described above, and to overcome other limitations that will become apparent upon reading and understanding the present specification, the present invention discloses methodology for lapping plate conditioning-texturing, refurbishing and use of the lapping plate in providing lapping and polishing for air bearing surface generation.

Conditioning and texturing of lapping plate surfaces for air bearing surfaces (ABS) generation is achieved without the use of free abrasive particles and slurries. The texturing and conditioning promotes the maintenance of surface flatness, waviness and microprofiles of the lapping plate and can be achieved while the lapping plate is on the lapping machine. The kinetics of the methodology provides for rotating the lapping plate and a conditioning ring in rotating contact with both rotated in the same direction at different RPM. The conditioning ring is inclusive of an abrasive layer which is in contact with the top surface of the lapping plate and is pressed into rotating contact with the lapping plate. The conditioning ring has an abrasive layer which consist of hard abrasive particles such as diamonds and other abrasives held by hard bond by nickel plated or similar materials so that the abrasive particles cannot be removed from the ring during the conditioning process. The size of the hard particle depends on the texturing micro profile to be generated. The relative RPMs of the lapping plate and conditioning ring are calculated to generate epicycloids, hypocycloids, pericycloids or circles within the kinetics of the conditioning and texturing method. These kinetics and variations in relative RPMs allow for generation of different angles of grain attack and control relative direction when using the lapping plate for lapping and polishing subjects. In addition, the lapping plate conditioning and texturing can be influenced by the positioning of the conditioning ring relative to the lapping plate center which combined with the other kinetics of the process as well as particle size of the lapping ring abrasive particles generates the grooves of the lapping plate, severity of the grooves and geometry of the grooves ie. peaks and valleys as well as the number of grooves and their respective relationships. These textured and conditioned lapping plates are used for ABS generation but can be used in any process using soft material plates for lapping and polishing as opposed to the so called hard plates utilized for grinding.

In addition, the present invention provides a lapping method utilizing the textured and conditioned lapping plates which are most suitable for finishing magnetic heads resulting in improved surface quality less sensitivity to electrical shorts due to smears and reduced surface height difference (recession) between the head elements exposed at the slider air bearing surface. The prior art lapping process maintains a work piece against the surface of the lapping plate providing random motion between the work piece and the lapping plate surface. The lapping process can proceed in a succession of steps or phases in which a rough lapping phase using a diamond slurry is followed by a second phase or polishing phase that maintains the same mechanical motion between the work piece and lapping plate but utilizes only the lapping plate to polish the work piece surface and to clean up any deep textured marks resulting from the diamond slurry phase. During the lapping and polishing phases, a conductive liquid such as ethylene glycol is utilized to provide lubrication and to minimize any buildup of static charge. In addition, sodium citrate eg di-tri-carboxylic organic acid salts, oxalate or tartrates are added to the solvent eg. glycol when lapping sliders. The sodium citrate performs a surfactant function as opposed to the functions utilized in various grinding operations wherein the sodium citrate complexing with alkaline metal hypochlorite to capture silicone particles for passing the silicone particle waste away from silicone grinding. The surfactant function enhances the lubrication by directing the glycols to form into smaller droplets.

The lapping process of the present invention begins with a specifically textured and conditioned lapping plate having no abrasive particles embedded therein however upon utilizing the lapping plate on the work piece, a slurry of glycol abrasive (diamond) particles are presented to the lapping plate surface which is in contact with the ABS subject. The abrasive, generally diamond, is held in the textured lapping plate grooves for lapping and polishing of the ABS surface. Such use of the specifically and controlled grooved lapping plate along with adjustable abrasive particle size introduced as a slurry provide versatility of operation for lapping and polishing of the ABS surfaces and other surfaces which requires soft lapping plate surface materials.

These and various other advantages and features of novelty which characterize the invention are pointed out particularly in the claims annexed hereto and form a part hereof. However, for a better understanding of the invention, its advantages, and the objects obtained by its use, reference should be made to the drawings which form a further part hereof and to accompanying descriptive matter, in which there is illustrated and described specific details of the methodologies and apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

The present invention relates to methodology for providing improved high performance digital magnetic recording devices for reading and writing data magnetically.

Figure 1:
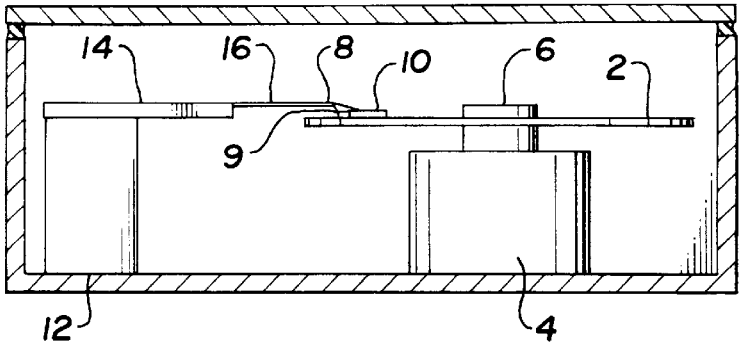
FIG. 1 is a section view of a magnetic recording disc drive and slider assembly.
Figure 2:
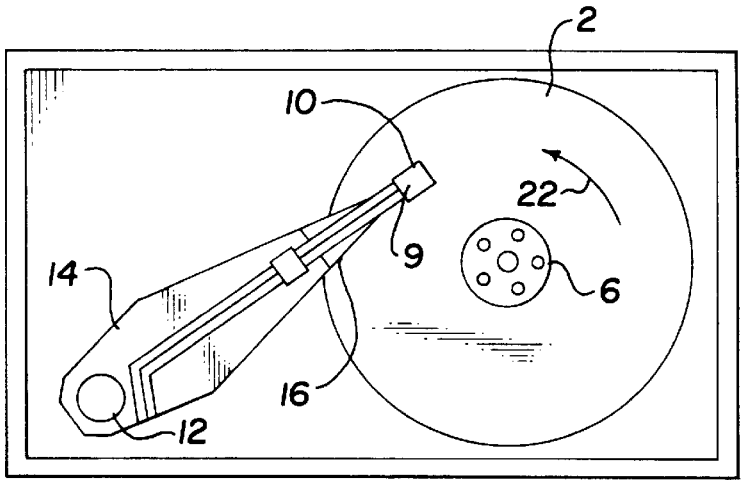
FIG. 2 is a top view of a magnetic recording disc drive and slider assembly.

Referring to FIGS. 1 and 2, there is shown a magnetic recording disc drive, a magnetic recording disc 2 which is rotated by drive motor 4 with hub 6 which is attached to the drive motor 4. The recording disc 2 comprises a substrate, a metallic magnetic layer, a carbon layer and a polymeric lubricant layer eg. perifluoropolyether.

A read/write head or transducer 8 is formed on the trailing end of a carrier, or slider 10. Sliders are positive or negative air bearing sliders. The slider 10 has a trailing surface 9, head 8 which may be an inductive read and write transducer. The slider 10 is connected an actuator 12 by means of a rigid arm 14 and a suspension element 16. The suspension element 16 provides a bias force which urges the slider 10 toward the surface of the recording disc 2. During operation of the disc drive, the drive motor 4 rotates the recording disc 2 at a constant speed in the direction of arrow 22 and the actuator 12 which is typically a linear or rotary motion coil motor drives the slider 10 generally radially across the plane of the surface of the recording disc 2 so that the read/write head may access different data tracks on recording disc 2.

Disc drive systems are widely used to store data and software for computer systems. A disc drive system generally includes a disc storage media mounted on a spindle such that the disc can be rotated thereby permitting an electronic magnetic head mounted on a moveable arm to read and write information thereon. The electromagnetic head for a disc drive system is usually mounted in a carrier called a slider. The slider serves to support the head and any electrical connections between the head and the rest of the disc drive system. The slider maintains a uniform distant from the surface of the rotating disc to prevent the head from undesirably contacting the disc. This is accomplished by incorporating aerodynamic features into the slider which causes the slider to glide above the disc surface over the moving air. In one aspect, the slider contact surface is finely finished and polished in order to achieve the aerodynamic requirements for utilization in ABS applications.

In order to meet the increasing demands for more and more data storage capacity, slider fabrication and ABS surface finishing must be improved to meet these demands. To meet these demands, lapping and polishing methodology as well as the texturing and conditioning and refurbishing of lapping plates surfaces must be developed which enhance lapping processability of air bearing surface features.

Figure 3:
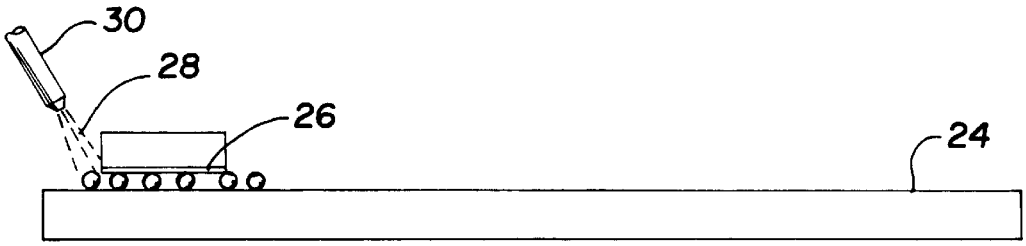
FIG. 3 is a side sectional view presenting a lapping plate in lapping contact with an ABS subject surface.

The cross sectional view of FIG. 3 shows the utilization of an improved lapping plate 24 in lapping contact with a slider ABS surface 26. The lapping process utilizes a source of diamond slurry 28, the slurry comprised of various fluid elements including ethylene glycol and sodium citrate. The glycols provide lubrication for the lapping process while the sodium citrate related materials provide a surfactant effect which enhances the lubrication characteristics of the glycols. The abrasion particle slurry or diamond slurry 28 provided through a spray nozzle 30 connected to and sourced by a free mixed slurry container not shown.

Figure 4:
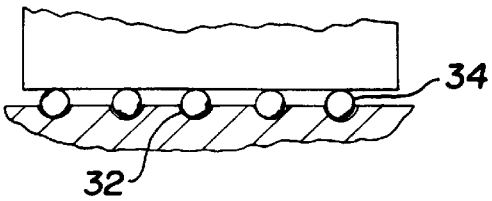
FIG. 4 is an enlarged segment of the side view of FIG. 3 in cross section showing detail of the lapping plate grooves and free abrasive particles in contact with the surface of the ABS subject.

FIG. 4 is an enlarged cross sectional view of the area of lapping contact of the lapping plate 24 and slider ABS surface 26. The enlarged side view presents the lapping plate 24 having grooves 32 which hold the free abrasive (diamond) 34 thus providing quality lapped ABS surfaces which are substantially scratch free.

Figure 5:
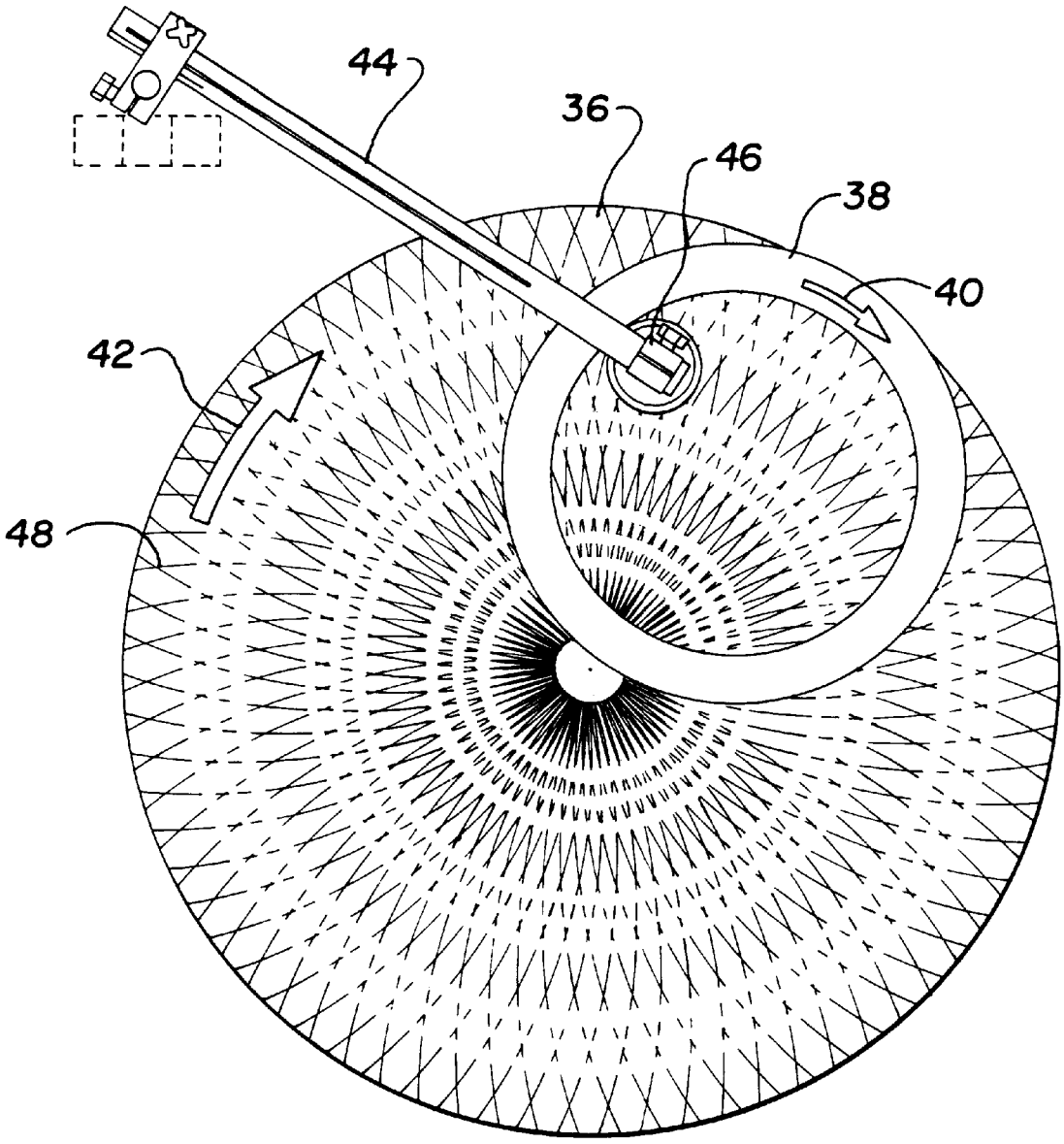
FIG. 5 is a top view of a conditioning ring in rotating contact with a lapping plate surface for conditioning and texturing the lapping plate surface.

The top view of FIG. 5 shows a lapping plate 36 contacted by a conditioning ring 38 with the relative rotational kinetics of the conditioning ring shown by arrow 40 and the lapping plate rotational direction shown by arrow 42. The conditioning ring 38 is positioned by lever arm 44 having a drive head 46 for producing the rotation of the conditioning ring 38. The lapping plate 36 shows various grooves formed in configurations of pericycloids, epicycloids, hypocycloids and circles 46. The conditioning ring 38 has an embedded diamond layer or other hard abrasive particles held by hard bound materials for example nickel-plated or similar surfaces so that the particles cannot be removed from the ring during the conditioning process.

Previous attempts in providing lapping plates incorporating grooves formed between the working surface areas in which an abrasive such as diamond particles were embedded in a metallic coat. The grooves were utilized to sweep beneath the work piece to remove abrasive particles as the abrasive disc rotated. Prior problems with grooved lapping plates included excessive width and depth of grooves or uncontrolled groove dimensions which allowed the abrasive particles if presented in a slurry to locate in such excessive grooves and loose their functionality for further abrasive action. Further, these undesired oversized grooves provided a surface discontinuity to severe for small work pieces. Refurbishment of these lapping surfaces required removal of the grooves and regrooving which presented additional expense of time and energy.

In addition to designed groove geometry, the number of grooves on the lapping plate surface can provide high percentage of lapping surface engagement. The lapping plate surface grooves provides interruption of the planarity of the lapping surface to reduce the hydrodynamic film from the abrasive slurry permitting the work piece to interact more intimately with the lapping plate. This substantially reduces hydroplaning. The result of the precision grooving carrying loose abrasive particles is a more effective use of the abrasive particles suspended in the abrasive slurry resulting in increased lapping rates, particularly as compared to the expected rate for a similar surface area provided with grooves having undesired geometry.

In one embodiment of the methodology in accordance with the present invention, the lapping plate is rotated from about 20 to about 100 RPMs with the conditioning ring rotating in the same direction of rotation as that of the lapping plate but only at about 0.5 to about 0.9 of the RPMs of the lapping plate. Pressure contact of the conditioning ring with the lapping plate ranges from about 2 to about 15 psi with the conditioning ring containing abrasive particles such as diamond particles of about 80 to about 320 micron particle size with about 160 microns as an average working particle abrasive size. Kinetics of the lapping plate and conditioning ring relationship provide geometry of the grooves, severity of the grooves including peaks to valleys. Lapping plates produced by the method of the invention are suitable for lapping and polishing slider ABS surfaces and any other surface requiring precision lapping and polishing utilizing a soft material lapping plate. During the conditioning and texturing of the lapping plate, the abrasive particles utilized by the conditioning ring are hard mounted in materials which do not release the particles thus the process produces lapping plate grooving without any foreign contamination or residue buildup.

The lapping plate is considered a soft lapping plate surface and is comprised of about 97.5 percent tin compounded with various other materials. The textured lapping plate surface is produced with grooves comprising at least about 5 to about 10 percent of the lapping plate surface. Various grooved profiles are generated by the relative RPM motions of the lapping plate and conditioning ring. Grooves have different angles of grain attached which produce and control relative direction of lapping when utilizing the lapping plate surface against a subject surface to be lapped and polished.

Although specific embodiments have been illustrated and described herein, it will be appreciated by those of ordinary skill in the art that any arrangement that is calculated to achieve the same purpose may be substituted for the specific embodiments shown. The foregoing description of the preferred embodiments of the invention have been presented for the purposes of illustration and description. They are not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A process for lapping an air bearing surface to provide a desired surface dimension comprising:

supporting at least one magnetic transducer such that an air bearing surface is exposed; and contacting the exposed air bearing surface with a rotating lapping plate surface coated with a slurry of free particle abrasives disposed in glycol and a carboxylic organic acid salt.

2. The process of claim 1 wherein the organic acid salt is sodium citrate, oxalate or tartrate.

3. A process for lapping air bearing surfaces to provide a desired surface dimension comprising:

supporting at least one magnetic transducer such that an air bearing surface is exposed;

contacting the exposed air bearing surface with a moving lapping plate surface, the lapping plate surface having a lapping surface with multiple grooves of circular, pericycloids, epicycloids, and hypocycloids patterns dominating at least about 5 to about 10 percent of the square area of the lapping plate surface;

the air bearing surface being conditioned and textured by the lapping plate surface through addition of slurry carrying free particle abrasives during lapping, the free particle abrasives being deposited in the lapping plate surface grooves; the free abrasive particle slurry comprised of glycols for lubricating purposes and sodium citrate for surfactant purposes for enhancing the lubrication qualities of the glycols.

4. The process for lapping air bearing surfaces according to claim 3 wherein the magnetic transducer is supported so that the air bearing surface is in contact with the lapping plate surface, the lapping plate surfaces having multiple grooves formed therein with the grooves being contoured to match the air bearing surface; and moving the lapping plate surface in respect to a magnetic transducer air bearing surface while in contact with the air bearing surface.

5. The process for lapping air bearing surfaces according to claim 3 wherein the magnetic transducer is supported such that the air bearing surface is in contact with the lapping plate surface;

providing relative motion between the magnetic transducer and said lapping plate surface, the air bearing surface of the magnetic transducer in contact with the lapping plate surface;

moving the lapping plate surface in a continuous rotary contact with the air bearing surface.

* * * * *

UNITED STATES PATENT AND TRADEMARK OFFICE

CERTIFICATE OF CORRECTION

PATENT NO. : 6,050,879

DATED : April 18, 2000

INVENTOR(S) : Mikhail Yurik Dubrovsky, Yuri Igor Markevitch, Siloe Flores Saldivar, Cornelius Vladimir Sutu It is certified that error appears in the above-indentified patent and that said Letters Patent is hereby corrected as shown below:

On the cover page item [73],

Assignee: International Business Machines Corporation
Armonk, New York

Signed and Sealed this

Twenty-sixth Day of September, 2000

*Attest:*

Q. TODD DICKINSON

*Attesting Officer*

*Director of Patents and Trademarks*